United States Patent [19]

Tsukuda

[11] 3,981,503

[45] Sept. 21, 1976

[54] GAME BOARD WITH GAME PIECE STORAGE AREA

[76] Inventor: Mitsuo Tsukuda, 3-1-3 Moto-Askusa, Taito, Tokyo, Japan

[22] Filed: Nov. 14, 1975

[21] Appl. No.: 632,114

Related U.S. Application Data

[63] Continuation of Ser. No. 481,204, June 20, 1974, abandoned.

[52] U.S. Cl. ..... 273/136 K; 220/252; 273/130 R; 273/137 R

[51] Int. Cl.[2] ..... A63F 3/00

[58] Field of Search ..... 273/130 R, 136 D, 136 K; 220/213, 252, 336

[56] References Cited

UNITED STATES PATENTS

| | | | |
|---|---|---|---|
| 1,266,857 | 5/1918 | Recker | 273/136 D |
| 1,430,778 | 10/1922 | Williams | 273/136 D |
| 1,970,128 | 8/1934 | Collins | 220/252 X |
| 2,235,615 | 3/1941 | Huffaker | 273/136 K UX |
| 2,235,885 | 3/1941 | Johnson | 220/213 |
| 2,736,452 | 2/1956 | Roop | 220/252 X |

*Primary Examiner*—Anton O. Oechsle
*Attorney, Agent, or Firm*—Jay M. Cantor

[57] ABSTRACT

A game board upon which a game is played with flat discs or chips is provided with at least one integrally formed pocket therein for storing the chips and a cover pivotally mounted on the end wall of the groove and movable below the pocket through a slit in the board.

2 Claims, 4 Drawing Figures

GAME BOARD WITH GAME PIECE STORAGE AREA

This is a continuation of application Ser. No. 481,204, filed June 20, 1974, and now abandoned.

The invention relates to an improvement in a game board upon which a game is played with chips or markers which are to be successively placed thereon by the players.

The game board of the invention is a flat surfaced board divided into squares as in a checkerboard, having any number of squares, preferably a total of sixty-four squares. A like number of discs or chips is provided, each having a diameter to fit within a square. The chips are provided with different colors on opposite sides, all chips bearing the same colors. The game is played by two players who first place four chips on the central four squares, adjacent chips showing different colors on opposite sides, all chips bearing the same colors. The game is played by two players who first place four chips on the central four squares, adjacent chips showing different colors. A player chooses a color and each in turn, places a chip with his color showing next to an opponent's chip in an effort to eventually sandwich opponent's chip either vertically, horizontally or diagonally of the board. When a player's chip is thus sandwiched, his chip is turned over to show the opponent's color. The largest number of chips of one color indicates the winner.

In games of this nature, in which a board and discs, markers or chips are utilized in conjunction therewith for playing a game, the discs are stored in boxes separate from the board. If a large number of discs are needed, as in the above game, they are stored in two or more boxes increasing the chances of being misplaced or loss of either the boxes or the play pieces therewithin. In order to obviate this, the game board of this invention is so constructed that it provides at least one and preferably two storage compartments on each side of the playing area thereof for storing the chips. The storage compartments are formed with covers which prevent the chips from falling out when the board is being carried about and which can be opened to permit access to the chips therein while being retained on the board out of the way of the players.

It is therefore an object of the invention to provide a game board having at least one compartment formed therein for storing play pieces used in playing on the board.

It is a further object of the invention to provide a game board with at least one compartment formed therein having a movable cover which is retained on the board out of the way of the players, when opened.

These and other objects of the invention will become apparent as the description proceeds with specific reference to the drawing in which.

Figure 1:
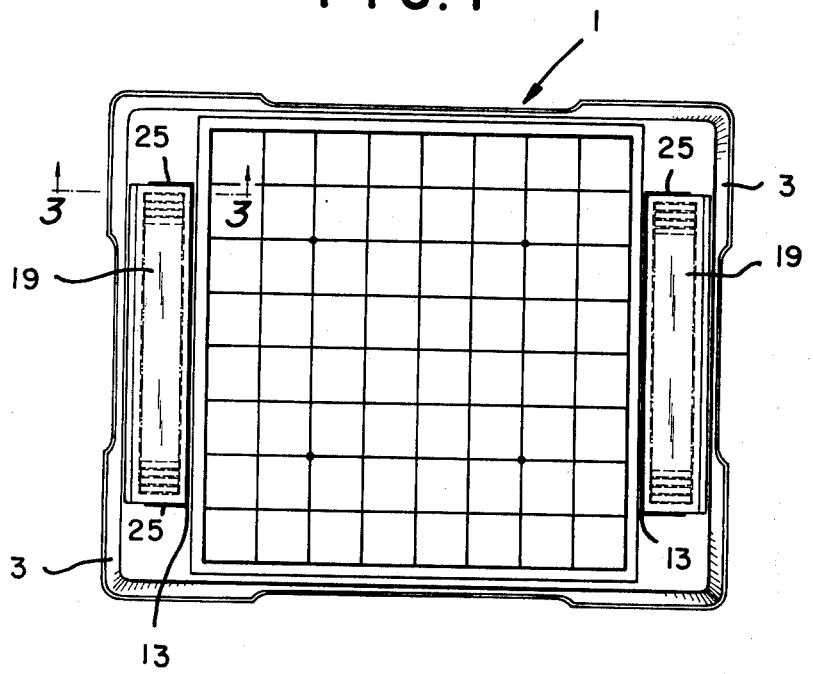
FIG. 1 is a plan view of the game board of this invention.
Figure 2:
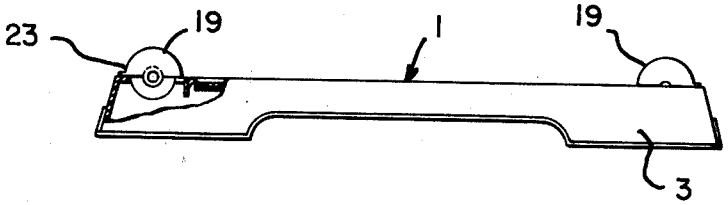
FIG. 2 is an end view of the game board of FIG. 1, partly in cross-section.

The game board is of a plastic synthetic resin having an upper surface 1 which is generally rectangular and integrally formed with a surrounding skirt portion 3 which extends downwardly and outwardly to provide a raised support for the upper surface of the board. The skirt portion may be cut away at its sides and ends to provide a space for entry of the fingers or a hand under the board for raising and carrying it. The upper surface 1 of the board has a central rectangular playing area 5 which is depressed to leave a rectangular frame portion 7 therearound. The upper surface is covered with a sheet 6 imprinted with a checkerboard design. Alternatively, the lines forming the squares may be etched into the playing surface of the plate.

Figure 3:
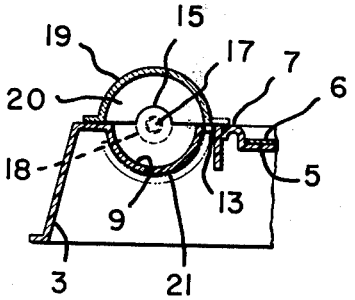
FIG. 3 is an enlarged cross-section along line 3—3 of FIG. 1.
Figure 4:
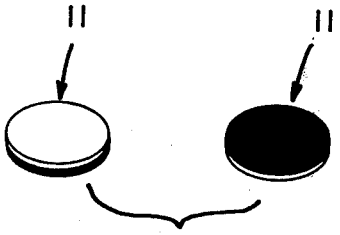
FIG. 4 is a perspective view of a pair of play pieces each having a different colored top.

An intermediate portion of each side of the board, outwardly of the frame portion, is depressed to form a pocket or groove 9. The grooves are semicircular in cross-section and of a diameter substantially equal to that of the play pieces 11 which are used for play on the board. The play pieces are in the form of flat circular discs of substantially rigid material. The ends of the grooves 9 terminate in planar walls transverse to the board, so that the play pieces can be stacked upright on their edges from one end wall of the groove to the other. A slit 13 is formed in the upper surface of the board between each groove 9 and the frame portion 7 of a length substantially that of the groove. The semicircular end walls of each of the grooves, is provided with an extended wall portion 15 having an opening 17 therethrough substantially along the axis of the groove. A plastic cover 19, in the form of a semicircular cylinder of a diameter slightly larger than a play piece, is provided with semicircular end walls 20 which have outwardly projecting pin-like elements 18 extending into the openings 17 for rotatably mounting the cover for movement about the axes of the grooves and cover. As can be seen from the drawings, when the cover 19 is rotated clockwise in FIG. 3, to expose the groove, the forward or right hand edge of the cover enters the slit 13 and moves under the wall 21 of the groove. The cover is provided at its rearward or left hand edge as seen in FIG. 3, with an axially extending ledge 23 to provide a stop for the cover when it is entirely open and within the slit. The slit 13 also includes a short transversely extending portion 25 along its ends to accommodate the semicircular end walls of the covers 19.

Having thus described my invention and the preferred mode of making and using it, obvious changes may occur to persons skilled in the art without departing from the spirit and scope thereof as defined by the following claims:

What is claimed is:

1. A rectangular game board provided with an integrally formed raised support at its edges, said game board having a rectangular upper playing surface upon which flat circular play pieces are deployed, a raised bead portion surrounding said playing surface and being an integral part of said game board and a marginal extension outwardly from a pair of opposite sides of the bead portion, said game board having a depressed portion in at least one of said marginal extensions below and adjacent said surface forming a groove which is semicircular in cross-section and having end walls, said groove forming a storage area for the play pieces, a cover for the storage area comprising a semicircular cylindrical member having end walls and of slightly larger diameter than said groove, cooperating means on the end walls of the groove and cover substantially along their axes for mounting the cover for rotary movements about said axes, said game board having a slit therethrough along a side and a portion of the ends of the groove from said side to said cooperating means for receiving the cover and its end walls when moved to open about its rotary axis the portion of said slit along said side of said groove being coextensive with and in the path of rotation of said cover.

2. A game board according to claim 1 wherein the edge cover furtherest from the slit when closed, is provided with a radially extending ledge to span said slit to form a stop when the cover is fully opened.

* * * * *